US006267279B1

(12) United States Patent
Matthews

(10) Patent No.: US 6,267,279 B1
(45) **Date of Patent: *Jul. 31, 2001**

(54) HAND WEAPON HOLSTERING SYSTEMS

(75) Inventor: John Wallace Matthews, Newport Beach, CA (US)

(73) Assignee: Laser Products Ltd., Fountain Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/419,352

(22) Filed: Oct. 15, 1999

Related U.S. Application Data

(63) Continuation-in-part of application No. 08/849,566, filed on May 27, 1997, now Pat. No. 6,112,962.

(51) Int. Cl.[7] ..... A45F 3/00

(52) U.S. Cl. ..... 224/243; 224/191; 224/192; 224/193; 224/242; 224/245

(58) Field of Search ..... 224/192, 193, 224/242–245, 232, 271, 272, 670, 911, 912, 191; 42/100, 103

(56) References Cited

U.S. PATENT DOCUMENTS

| | | | |
|---|---|---|---|
| 1,166,781 | 1/1916 | Parrish . | |
| 1,430,081 | 9/1922 | Holler . | |
| 1,641,439 | 9/1927 | Jovino | 224/244 |
| 2,551,913 | 8/1951 | Toby | 224/2 |
| 2,765,107 | 10/1956 | Browning | 224/2 |
| 3,642,184 | 2/1972 | Hendricks | 224/2 C |
| 3,910,469 | 10/1975 | Baldocci | 224/2 C |
| 4,121,743 | 10/1978 | Burton | 224/269 |
| 4,313,272 | 2/1982 | Matthews | 42/1 A |
| 4,383,371 | 5/1983 | Coffey | 33/245 |
| 4,777,754 | 10/1988 | Reynolds, Jr. | 42/103 |
| 4,856,218 | 8/1989 | Reynolds, Jr. | 42/103 |
| 5,127,566 | 7/1992 | Beletsky | 224/243 |
| 5,150,825 | 9/1992 | Nichols | 224/243 |
| 5,199,620 | 4/1993 | Beletsky | 224/243 |
| 5,208,826 | 5/1993 | Kelly | 372/107 |
| 5,215,238 | 6/1993 | Baruch | 224/243 |
| 5,269,448 | 12/1993 | Shoemaker | 224/243 |
| 5,275,317 | 1/1994 | Rogers et al. | 224/244 |
| 5,282,559 | 2/1994 | Wisser et al. | 224/243 |
| 5,284,281 | 2/1994 | Nichols | 224/244 |
| 5,299,375 | 4/1994 | Thummel | 42/103 |
| 5,358,160 | 10/1994 | Bianchi | 224/244 |
| 5,395,021 | 3/1995 | Brown | 224/244 |
| 5,421,497 | 6/1995 | Gilmore | 224/198 |
| 5,467,909 | 11/1995 | Resca | 224/244 |
| 5,471,777 | 12/1995 | McDonald | 42/103 |
| 5,598,958 | 2/1997 | Ryan, III et al. | 224/198 |
| 5,630,535 | 5/1997 | Valenti | 224/271 |
| 5,654,594 | 8/1997 | Bjornsen, III et al. | 307/115 |
| 5,671,561 | 9/1997 | Johnson et al. | 42/103 |
| 5,758,448 | 6/1998 | Thummel | 42/103 |
| 5,794,347 * | 8/1998 | Serpa | 30/162 |

FOREIGN PATENT DOCUMENTS 2107292 9/1971 (DE) .

* cited by examiner

*Primary Examiner*—Timothy L. Maust

(57) ABSTRACT

A holstering device is made for an elongate hand weapon or is made as a standard holstering device for holstering any one of a number of different types of elongate hand weapons. Such holstering device extends along opposite first and second sides of any of these hand weapons and straddles that hand weapon between such opposite first and second sides when that hand weapon is holstered. The holstering device also includes a track structure having in that holstering device a first track at the mentioned first side and a second track at the mentioned second side. Each of such elongate hand weapons is equipped with an adapter having first and second slides complementary with the first and second tracks of the track structure for holstering the adapter in that track structure while holstering any of the elongate hand weapon in that holstering device. Each adapter is made integral with a corresponding elongate hand weapon as distinguished from the holstering device, so that such adapter is removed with that elongate hand weapon from that holstering device when that hand weapon is drawn from that holstering device.

45 Claims, 12 Drawing Sheets

HAND WEAPON HOLSTERING SYSTEMS

CROSS-REFERENCE TO PARENT APPLICATIONS

This is a continuation-in-part of patent application Ser. No. 08/849,566, filed May 27, 1997 by John Wallace Matthews, Ph.D., now U.S. Pat. No. 6,112,962, as National Phase of International Application PCT/US95/09471, filed on Jul. 26, 1995 by Laser Products Corporation, the general partner of the Assignee of the entire interest hereof, as International applicant, and by said John Wallace Matthews, Ph.D., and herewith incorporated by reference herein.

FIELD OF THE INVENTION

The subject invention relates to holstering systems for hand guns and other hand weapons, including holstering systems for different hand weapons, and systems for holstering hand weapons with target illuminators and other attachments.

BACKGROUND

The background of the invention is apparent from the above mentioned parent applications and from the prior art cited therein.

SUMMARY OF THE INVENTION

From a first aspect thereof, the invention resides in a method of holstering an elongate hand weapon, and, more specifically resides in the improvement comprising, in combination, forming a holstering device for that hand weapon extending along opposite first and second sides of that hand weapon and straddling that hand weapon between that opposite first and second sides when that hand weapon is holstered, providing a track structure including in that holstering device a first track at the mentioned first side and a second track at the mentioned second side, equipping that elongate hand weapon with an adapter having first and second slides complementary with the first and second tracks of the track structure for holstering that adapter in that track structure while holstering the elongate hand weapon in the holstering device, and making that adapter integral with the elongate hand weapon as distinguished from the holstering device, so that such adapter is removed with the elongate hand weapon from the holstering device when that hand weapon is drawn from that holstering device.

From a related aspect thereof, the invention resides in a method of holstering any one of a number of different types of elongate hand weapons, and, more specifically, resides in the improvement comprising, in combination, making for such different types of hand weapons a standard holstering device extending along opposite first and second sides of any of these hand weapons and straddling that hand weapon between the mentioned opposite first and second sides when that hand weapon is holstered, providing a track structure including in that holstering device a first track at the mentioned first side and a second track at the mentioned second side, equipping each of such elongate hand weapons with an adapter having first and second slides complementary with the first and second tracks of the track structure for holstering the adapter in that track structure while holstering any of the elongate hand weapon in that holstering device, and making each adapter integral with a corresponding elongate hand weapon as distinguished from the holstering device, so that the adapter is removed with that elongate hand weapon from that holstering device when that hand weapon is drawn from that holstering device.

From a related aspect thereof, the invention resides also in apparatus for holstering an elongate hand weapon, and, more specifically, resides in the improvement comprising, in combination, a holstering device for that hand weapon extending along opposite first and second sides of that hand weapon and straddling that hand weapon between such opposite first and second sides when that hand weapon is holstered, a track structure including in the holstering device a first track at the first side and a second track at the second side, and an adapter for that hand weapon having first and second slides complementary with the first and second tracks of the track structure and being integral with the elongate hand weapon as distinguished from the holstering device, so that such adapter is removed with the elongate hand weapon from the holstering device when that hand weapon is drawn from that holstering device.

From a related aspect thereof, the invention resides also in apparatus for holstering any one of a number of different types of elongate hand weapons, and more specifically resides in the improvement comprising, in combination, a standard holstering device for such different types of hand weapons extending along opposite first and second sides of any of these hand weapons and straddling that hand weapon between the mentioned opposite first and second sides when that hand weapon is holstered, a track structure including in that holstering device a first track at the mentioned first side and a second track at the mentioned second side, and an adapter for each of the hand weapons having first and second slides complementary with the first and second tracks of the track structure and being integral with that elongate hand weapon as distinguished from the holstering device, so that the adapter is removed with that elongate hand weapon from that holstering device when that hand weapon is drawn from that holstering device.

BRIEF DESCRIPTION OF THE DRAWINGS

The subject invention and its various aspects and objects will become more readily apparent from the following detailed description of preferred embodiments thereof, illustrated by way of example in the accompanying drawings which also constitute a written description of the invention, wherein like reference numerals designate like or equivalent parts, and in which.

DESCRIPTION OF PREFERRED EMBODIMENTS

Figures 1, 1A:
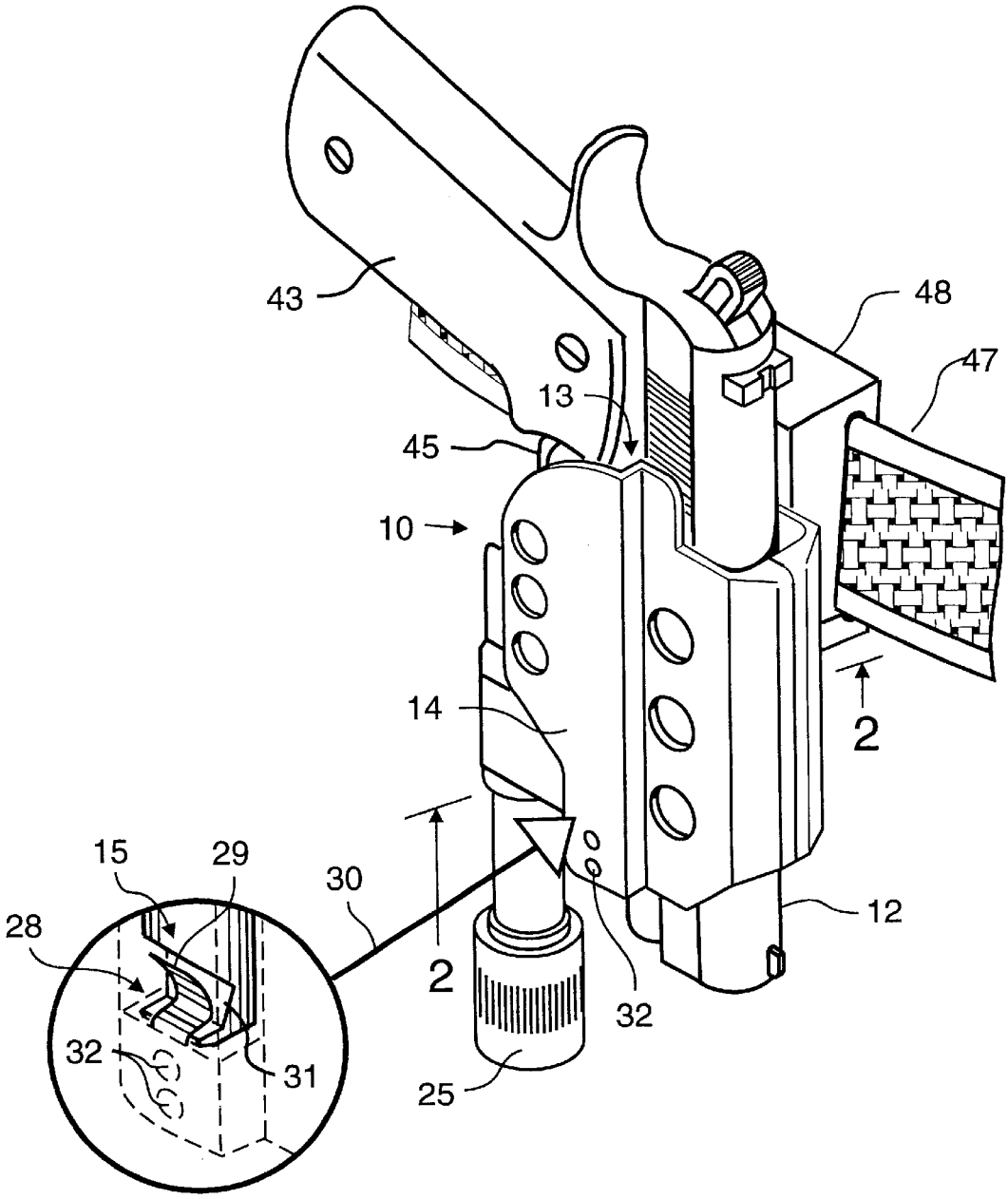
FIG. 1 is a perspective view of a hand weapon holstering system according to an embodiment of the invention.
FIG. 1A is a detail view, on an enlarged scale, of a detent that may be implemented in the holstering systems herein disclosed according to an embodiment of the invention.

The drawings illustrate and show methods and apparatus 10 for holstering handguns or other elongate hand weapons 12 according to embodiments of the invention. Such methods and apparatus provide or comprise a track structure 13 which is provided as a holstering device 14, 114 or 214 for the elongate hand weapon 12. In apparatus terms, holstering devices 14, 114 or 214 for elongate hand weapons 12 include the track structure 13.

Also according to an embodiment of the invention, such elongate hand weapon is provided with or comprises a slide structure or adapter 15, 115, 215 which is or is made complementary with the track structure 13 for holstering the slide structure or adapter 15, 115, 215 in that track structure, while holstering the elongate hand weapon 12 in its holstering device 14, 114 or 214. This may also be expressed by saying that the track structure 13 is or is made complementary with the slide structure or adapter 15, 115, 215 for holstering such slide structure or adapter 15, 115, 215 in that track structure, while holstering the elongate hand weapon 12 in its holstering device 14, 114 or 214.

Methods and apparatus according to embodiments of the invention for holstering an elongate hand weapon 12 in a holstering device 14, 114 or 214 having a track structure 13, reside in the improvement of providing such elongate hand weapon with a slide structure or adapter 15, 115, 215 complementary with the track structure 13 for holstering such slide structure or adapter in that track structure while holstering the elongate hand weapon in the holstering device 14, 114 or 214.

Conversely, embodiments of the invention reside in methods and apparatus for holstering an elongate hand weapon 12 having a slide structure or adapter 15, 115, 215 for holstering such elongate hand weapon in a holstering device 14, 114 or 214, which reside in the improvement of providing such holstering device with a track structure 13 complementary with the slide structure or adapter 15, 115, 215 for holstering that slide structure or adapter in the track structure while holstering the elongate hand weapon in the holstering device 14, 114 or 214.

Figure 4:
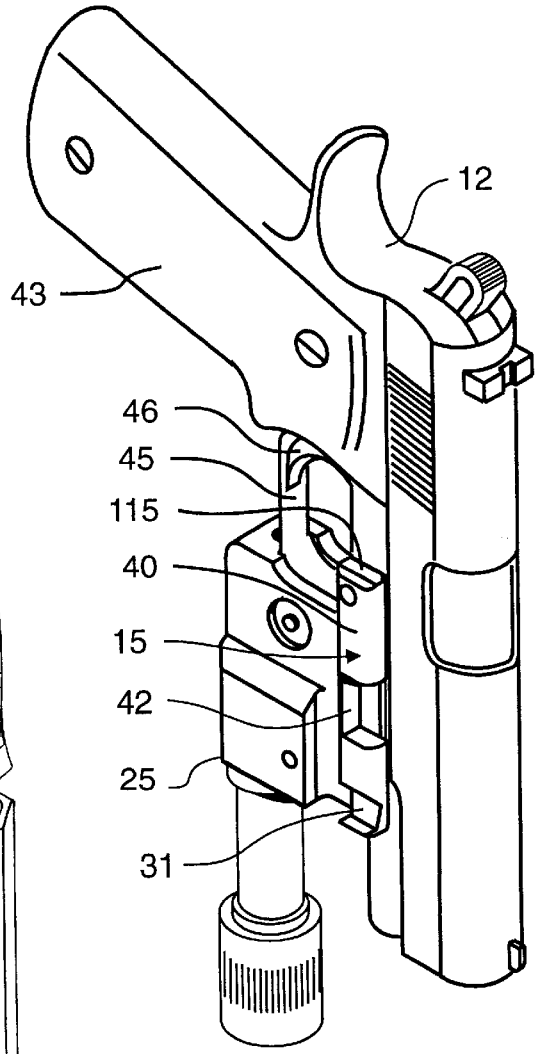
FIG. 4 is a perspective view of a hand weapon with holstering adapter according to an embodiment of the invention.
Figure 20:
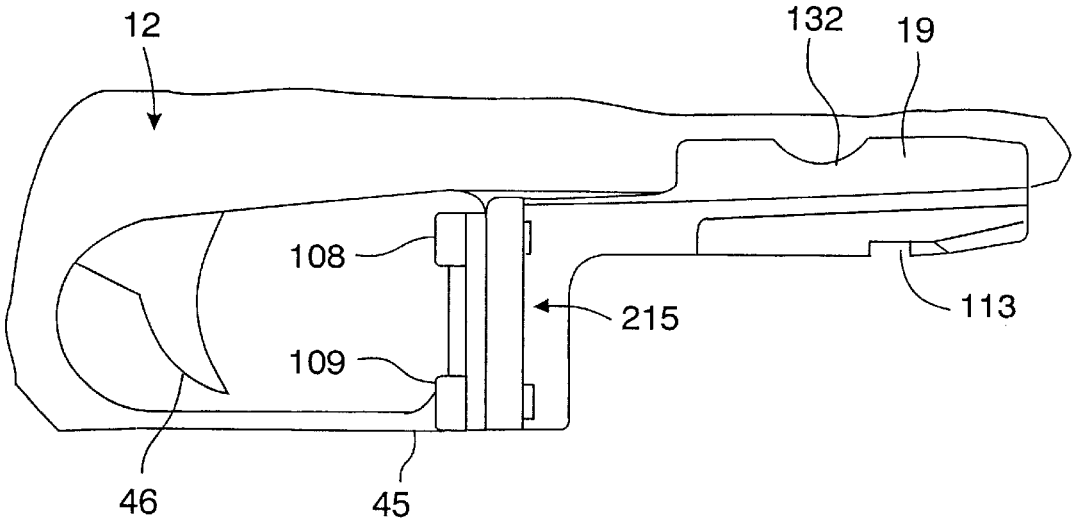
FIG. 20 is a fractional view of a hand weapon and of an adapter structure for holstering a hand weapon, such as in the holster shown in FIGS. 1 to 17, or for otherwise mounting a target illuminator, such as shown in FIG. 15 with the aid of dotted lines.
Figure 21:
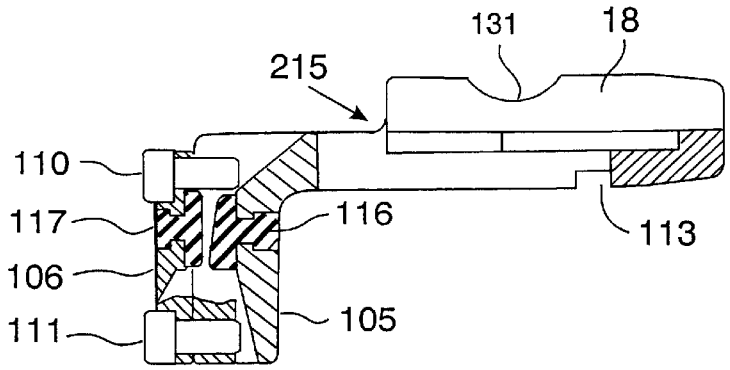
FIG. 21 is a longitudinal section through the adapter of FIG. 21.

In this respect the drawings, such as FIGS. 2, 2A, 2B, 2C, 4, 8, 15, and 20 show that the slide structure or adapter 15, 115, 215 is integral with the elongate hand weapon 12 as distinguished from the holstering device 14, 114 or 214, so that such slide structure is removed with that elongate hand weapon from that holstering device 14, 114 or 214 when that hand weapon is drawn from such holstering device such as seen in FIG. 4 and again in FIG. 20. As also seen in these drawings with reference to the other drawing FIGS. 1, 5, 10, 11 and 15, the holstering device 14, 114 or 214 according to the illustrated preferred embodiments of the invention is formed to extend along opposite first and second sides of the elongate hand weapon 12, 112, 212, 312 and to straddle that hand weapon between such opposite first and second sides when that hand weapon is holstered. In apparatus terms the illustrated holstering device 14, 114 or 214 for the hand weapon 12, 112, 212, 312 is extending along opposite first and second sides of the hand weapon and is straddling that hand weapon between such opposite first and second sides when the hand weapon is holstered. The dictionary words "to straddle" and "straddling" connote an astride position, such as, for example, seen in FIGS. 2 to 2C, 11 and 15, where the holstering device is shown astride of the hand weapon 12, 112, 212, 312.

Pursuant to a preferred embodiment of the invention, the track structure 13 is provided with or includes two tracks 16 and 17 in the holstering device 14, 114 or 214, and the slide structure or adapter 15, 115, 215 is provided with or includes two slides 18 and 19 complementary with those two tracks in the holstering device.

According to a related embodiment of the invention, the track structure 13 and slide structure or adapter 15, 115, 215 are provided as or comprise a tongue and groove combination, including a tongue structure, such as shown at 16 and 17, and a groove structure, such as shown at 18 and 19. Within the scope of the invention, such tongue structure, while shown as part of the track structure 13, could be on the slide structure or adapter 15, 115, 215, while the groove structure, while shown in such slide structure or adapter, could be in the track structure instead. In this respect, the drawings show the slide structure or adapter 15, 115, 215 with lateral tongues 21 and 22, and the track structure with corresponding grooves 23 and 24. Accordingly, the tongue and groove combination may include a tongue structure, such as shown at 16, 17, 21 or 22, as one of the track structure and slide structure or adapter, and a groove structure, such as shown at 18, 19, 23 or 24, as the other of the track structure and slide structure or adapter.

Figure 2:
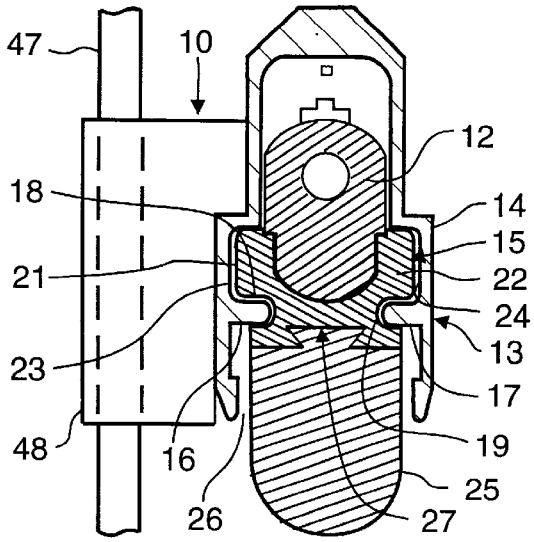
FIG. 2 is a section taken approximately on the line 2—2 in FIG. 1, and together with FIGS. 2A to 2C shows a standard holstering device for different types of weapons.
Figure 15:
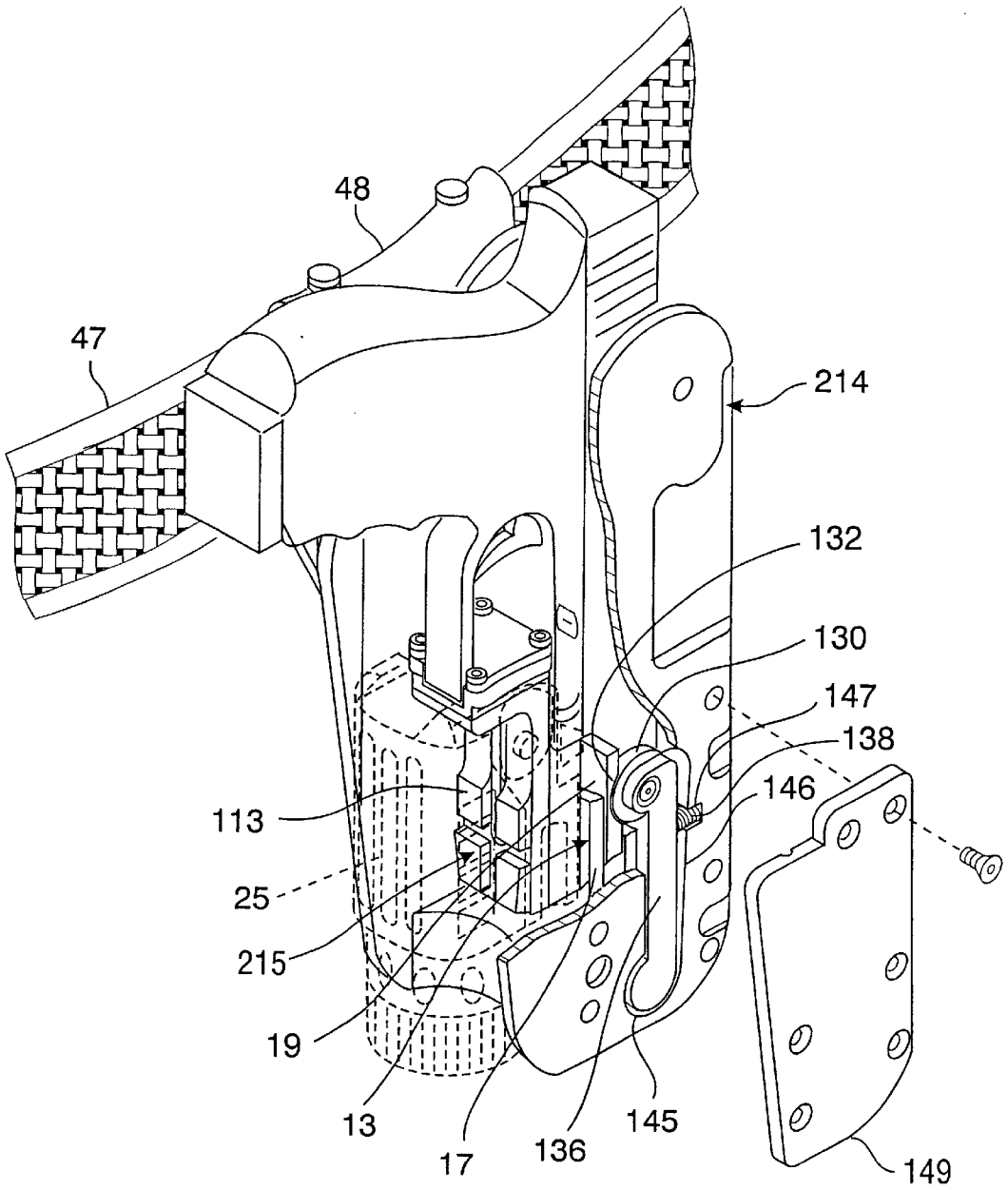
FIG. 15 is a perspective view similar to FIG. 14, but showing a holstered hand weapon with optional target illuminator, and having an edge portion broken away for better visibility of a detent and adapter structure.

For hand weapons having an accessory 25 exteriorly attached or otherwise exterior to, but part of, such hand weapon, the holstering device 14, 114 or 214, according to an embodiment of the invention, is provided with an accommodation for such accessory. Such accommodation may include an elongate opening 26 in the holstering device 14, 114 or 214, extending along the track structure 13 or the tracks 16 and 17 or the tongues 16 and 17. By way of example, FIGS. 4, 5, 11 and 15 show a target illumination light or lamp as the accessory 25. Other examples include a laser light, such as in U.S. Pat. No. 5,215,238, by Alan Baruch, issued Jun. 1, 1993 for a Holster for a weapon with Laser Light, or otherwise, and various auxiliary gun sights, pepper spray and mace containers, knives or bayonets, high-voltage or stunning devices, etc. etc., all symbolized in the drawings by an attachable accessory part 25. In this respect, FIG. 2 shows such accessory 25 attached to the slide structure or adapter 15 by a dovetail structure 27. FIGS. 15 and 20 show similar modes of attachment. Within the scope of the invention, a bayonet socket or any other mount for an accessory 25 for the hand weapon 12 may be provided at 27 as part of the hand weapon.

According to an embodiment of the invention, the holstering device 14, 114 or 214 is open along one side thereof, typically the rear side, such as seen in FIGS. 1, 2, A to C, 3, 5 to 10, 11, 12, and 14 to 16.

The overall goal of prior-art effort has been to provide each holster for a specific hand weapon. U.S. Pat. No. 5,275,317 by William H. Rogers and Norman E. Clifton, Jr., issued Jan. 4, 1994 for a Handgun Holster with a Lockable Trigger Guard Restraint typifies such prior-art goal by stating that its holster preferably is made "to have the unique contours to receive a selected handgun 20 and is not suitable as a holster for any other gun shape."

While holstering devices of the subject invention, indeed, may be made to receive only a specific hand weapon or handgun, preferred embodiments of the invention provide methods and apparatus for holstering any one of a number of different types of elongate hand weapons. Such methods provide a standard holstering device for such number of different types of elongate hand weapons, and provide each of such elongate hand weapon with an adapter interfacing with such standard holstering device 14, 114 or 214 for elongate hand weapons. By way of example, the slide structure or adapter 15, 115, 215 may serve as such adapter.

Where the standard holstering device 14, 114 or 214 is provided with or has a track structure 13, each adapter is a slide structure or adapter 15, 115, 215 complementary with that track structure in that standard holstering device. By way of example, where the track structure 13 is provided with two tracks 16 and 17 in the standard holstering device 14, 114 or 214, each slide structure or adapter 15, 115, 215 is provided with two slides 18 and 19 complementary with these two tracks in the standard holstering device.

Figure 2A:
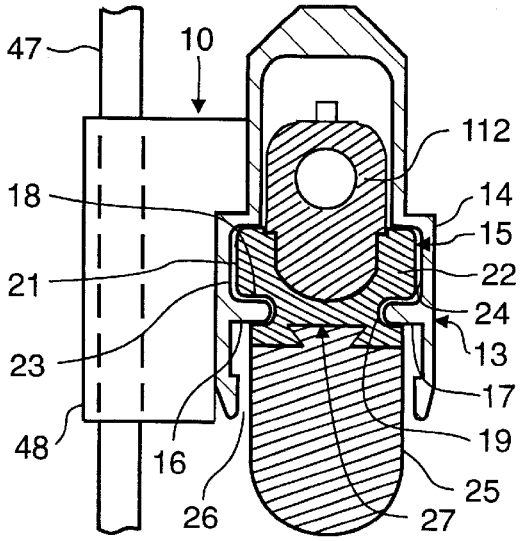
Figure 2B:
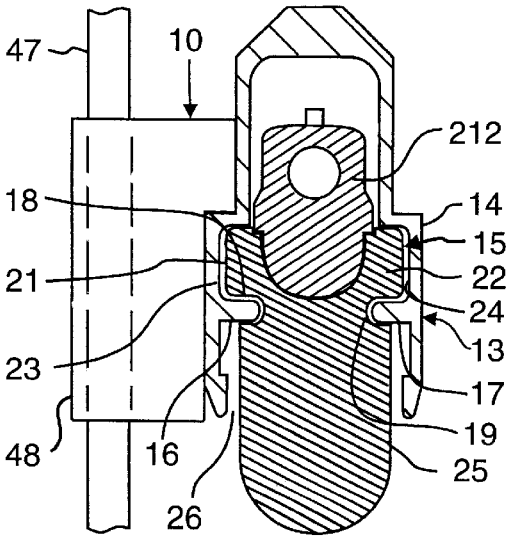
Figure 2C:
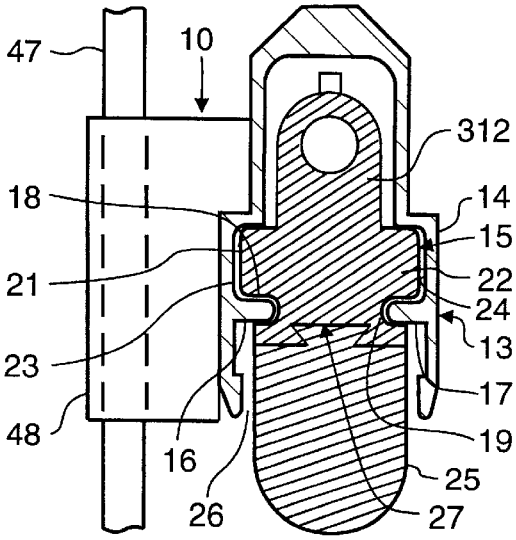

FIGS. 2 and 2A to C illustrate an embodiment of this principle. By way of example, FIGS. 2A, 2B and 2C show different types of hand weapons 112, 212 and 312. According to the embodiment of the invention illustrated in FIGS. 2 and 2A to 2C, all these different types of weapons 12, 112, 212, 312 are capable of being holstered in the same standard holstering device 14, 114 or 214; typically one at a time. Each of the weapons 12, 112, 212 and 312 has an adapter 15, 115, 215 interfacing with the standard holstering device for such weapons 12, 112, 212 and 312. While such adapter may be the above mentioned slide structure or adapter 15, 115, 215, the adapters for the different types of weapons 12, 112, 212, 312 need not be identical within the scope of the invention. By way of example, the adapter for the weapon 112 may be different from the adapter for the weapon 12, and so forth, as long as all adapters interface with the standard holstering device 14, 114 or 214.

Within the scope of the invention, any slide structure or adapter 15, 115, 215 may be manufactured separately from the hand weapon and may be attached or retrofitted to such weapon, or may be provided as part of any of the weapons during manufacture of such weapon or weapons.

However, the slide or adapter structures 15, 115, 215 of the different types of weapons 12, 112, 212, 312 all have to have some configuration that is complementary with essentials of the holstering device 14, 114 or 214.

The holstering device 14, 114 or 214 is the same for all of the different types of weapons 12, 112, 212, 312. Where such holstering device has a track structure 13 comprising one or more rails or tracks 16 or 17, adapters 15, 115, 215 will have a corresponding structure, such as shown at 18 and 19. Similarly, where such holstering device has a track structure 13 comprising one or more grooves 23 or 24, adapters 15, 115, 215 will have a corresponding structure, such as shown at 21 and 22.

In this respect, if the track structure 13 of the holstering device 14, 114 or 214 has one or more rails or tracks 16 or 17, as well as one or more grooves 23 or 24, then the adapters for the different types of weapons may for instance all be configured with one or more groove structures 18 and 19 and with one or more tongue structures 21 and 22, or adapters for some of the weapons 12, 112, 212, 312 may be provided with one or more groove structures 18 and 19, while other adapters for these different types of weapons may be provided one or more tongue structures 21 and 22 instead of groove structures, with all such different adapters fitting into the same standard holster 14, 114 or 214 for a holstering of all such different types of weapons.

So far, handguns have been mentioned as hand weapons. However, there are other hand weapons within the scope of the invention, including pepper spray and mace containers, knives or bayonets, intense light sources, high-voltage or stunning devices, etc. etc., that can be holstered by a holstering device 14, 114 or 214 standard for different ones of such weapons.

According to embodiments of the invention, the track structure and the slide structure or adapter are provided with or include a detent 28, 33 or 54 for releasably retaining or adapted to releasably retain such slide structure or adapter 15, 115, 215 at the track structure 13. In this manner, the hand weapon 12 is secure against falling out of the holstering device 14, 114 or 214, such as when the wearer rolls over or carries out some jumping motion or engages in similar action.

By way of example, FIG. 1*a* shows a latching device or latch 29 which is provided in the holstering structure 14, such as indicated by the arrow 30 in FIGS. 1 and 1*a*. The detent 28 also has a notch 31 in the slide structure or adapter 15, 115, 215 that corresponds with the latch 29. That latch may, for instance, be a leaf spring that is attached to the holstering device 14, such as by rivets 32, and that engages or is engaged by the slide structure or adapter 15, 115, 215 at its notch 31 when the hand weapon 12 is holstered in its holster 14.

Some applications and situations require greater safety against loss or removal of the weapon from its holster. Law enforcement and military personnel, for instance, are often exposed to situations in which law breakers or attackers attempt to take away, or even have succeeded in taking away, the hand weapon from its holster, frequently with the intent of injuring its wearer or of committing another crime or assault with the wrested away hand weapon.

Accordingly, a preferred embodiment of the invention provides the holstering device and slide structure or adapter with a detent 33 or 54 which releasably retains or which is adapted to releasably retain the slide structure or adapter 15, 115, 215 at the track structure 13 until a wearer of the holstered hand weapon 12 pulls that hand weapon from the holstering device or, in other words, until the holstered hand weapon is pulled from its holstering device 14, 114 or 214 by the wearer of that holstering device.

Figure 7:
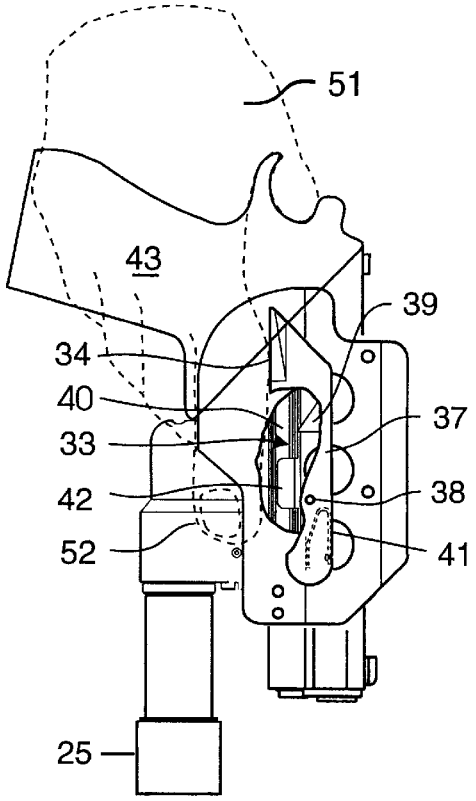
FIG. 7 is a detail view similar to FIG. 6, showing the normally unlatched holstered condition of the hand weapon of FIG. 5, and indicating a normal draw of the hand weapon by the hand of the wearer of the holstered hand weapon.
Figure 5:
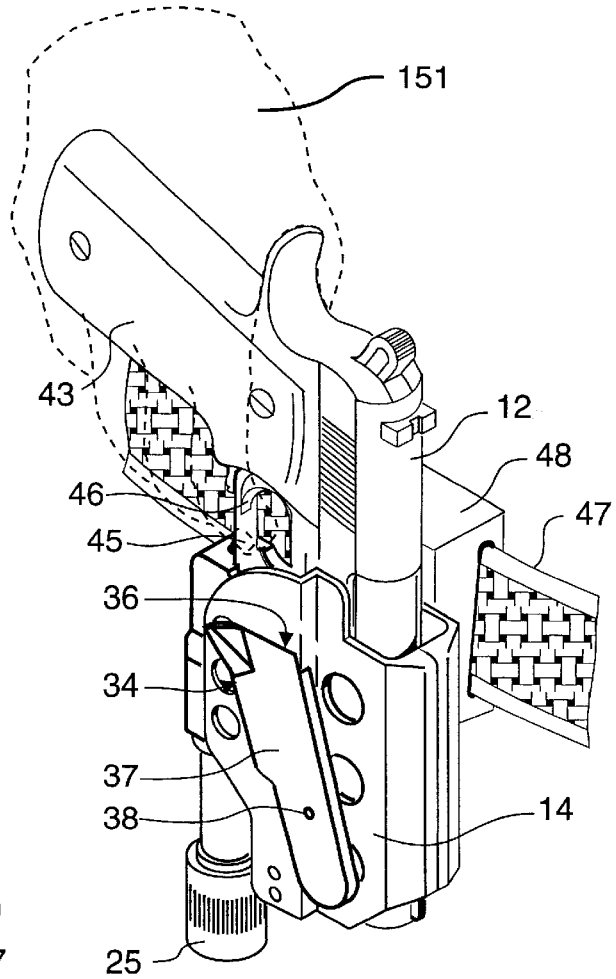
FIG. 5 is a perspective view of a holstering system according to a further embodiment of the invention, showing the hand weapon half drawn from the holster, such as by an assailant.
Figure 6:
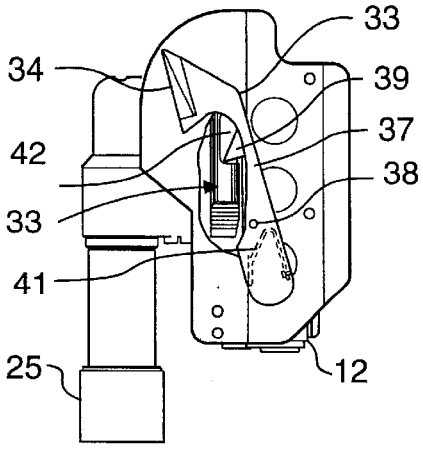
FIG. 6 is a side view of the holster region of FIG. 5, with parts broken away to show a safety mechanism of the holstering structure of FIG. 5 in action.

A preferred embodiment of the invention, such as shown in FIGS. 5 to 7, provides the track structure 13 or other part of the holstering device 14, and the slide structure or adapter 15 with a detent 33 for releasably retaining such slide structure or adapter at that track structure against removal of the holstered hand weapon 12 from its holstering device 14, and, more specifically, provides such detent with a device 34 for sensing a presence of a part of a hand 51 of a wearer of the holstered hand weapon at a predetermined location at that holstering device 14 and deactivates that detent in response to such presence of that part of the hand 51 at that predetermined location 36.

By way of example, the wearer-hand-sensing device 34 includes a lever 37 that is pivoted, such as at 38. The lever 37 carries or is coupled to a latching device or latch 39 that is biased against the slide or adapter structure 15 on the hand weapon 12, such as by a spring 41. In addition to such latch 39, the detent 33 includes a notch 42 in the slide structure or adapter 15 that corresponds to the latch 39.

Within the scope of the invention, the biased latch 39 may engage the slide structure or adapter 15 at its notch 42 when the hand weapon is holstered in its holster 14. An assailant thus would be prevented from pulling the hand weapon 12 from its holster 14, as such assailant would have to move the lever 37 effectively while pulling the hand weapon 12 out of its holster 14, all against the will and the resistance of the wearer of the hand weapon.

On the other hand, if the wearer of the holstered hand weapon intends to draw such hand weapon 12 from its holster 14, then such wearer grips the handle or stock 43 of the hand weapon with one hand 51, such as the "gun hands" in the case of a handgun. Simultaneously, the wearer places the side of that one hand 51 along the index finger or trigger finger 52 against the hand sensor 34, thereby pushing or angularly moving the lever 37 about its pivot 38 until the latch 39 is disengaged from the notch 42 in the slide or adapter structure 15. This enables the wearer to draw the weapon 12 without fumbling with leather straps or other prior-art security device which impede a fast draw and thereby impair the value of the weapon and the safety of its user.

A preferred embodiment of the invention even relieves the wearer from any conscious action as far as the safety against unauthorized or violent removal of the weapon from its holster is concerned.

In this respect, FIG. 7 shows a preferred embodiment according to which the latch 39 rest on an unnotched portion 40 of the slide or adapter structure 15 when the weapon 12 is fully inserted in its holster 14.

In this preferred embodiment of the invention, gripping the weapon 12 at its handle or grip 43 automatically prevents the security system 33 from locking the weapon in its holster. The marksman or authorized user can draw the weapon 12 as fast as if no safety 33 were present, with the latch 39 clearing the slide structure or adapter 15 including its notch 42 all the way, as the side of the user's hand 51 along the index finger or trigger finger 52 slides along the lever 37 at its hand sensor portion 34.

This preferred embodiment of the invention requires no action by the weapon user or shooter other than what shooters always have done in drawing a handgun; namely having the trigger finger 52 outstretched downward outside the holster during the draw for insertion of that trigger finger into the trigger guard area 45 as that trigger finger is bent for actuation of the trigger 46 and possible firing of the weapon.

In this respect and in general, an aspect of the invention resides in a method of holstering an elongate hand weapon 12 and, more specifically, resides in the improvement of providing a holstering device 14, holstering the hand weapon in that holstering device, drawing the hand weapon from that holstering device with a hand 51 having an outstretched finger 52, and blocking removal of the hand weapon from the holstering device upon attempts to remove the hand weapon from the holstering device without the hand having the outstretched finger 52.

An embodiment of the invention provides a method which includes providing the elongate hand weapon 12 and the holstering device 14 with a normally deactivated detent 33 or 39 and 42 at 15 for selectively retaining the hand weapon in the holstering device, and activating such detent only upon attempts to remove the hand weapon from the holstering device without the hand 51 having the outstretched finger 52.

Apparatus within the scope of the currently disclosed aspect of the invention for holstering an elongate hand weapon 12, comprise a holstering device 14 for such hand weapon, and a detent 33 or 39 and 42 at 15 adapted to block removal of the hand weapon from the holstering device upon attempts to remove such hand weapon from that holstering device without a hand 51 having a finger 52 outstretched substantially parallel to the elongate hand weapon 12.

According to the preferred embodiment illustrated in FIGS. 5 to 7, the detent is a normally deactivated detent, such as the detent 39 resting on the unnotched portion 40 of the slide structure or adapter 15 when the weapon 12 is seated in its holster 14. However, such normally deactivated detent is capable of selectively retaining, or is adapted to selectively retain, the hand weapon in its holstering device. In this respect, a detent activator, such as shown at 41, is adapted to activate the detent only upon attempts to remove the hand weapon from the holstering device without the hand 51 having the outstretched finger 52, such as by prompting the detent 39 into the notch 42 when the trigger finger portion of the wearer is missing at the lever or sensor 34 in the area 36.

In this respect, FIG. 5 shows the hand 151 of an assailant whose effort to remove the weapon from the holster is frustrated by the safety mechanism 33.

Within the scope of that aspect of the invention, the holstering device 14 again may be provided with a track structure 13, and the elongate hand weapon 12 is then provided with a slide structure or adapter 15 complementary with that track structure for holstering such slide structure or adapter in the track structure while holstering the elongate hand weapon in the holstering device 14. Moreover, use of safety mechanisms according to aspects of the subject invention is not limited to specific track and slide structures or adapters.

Figure 8:
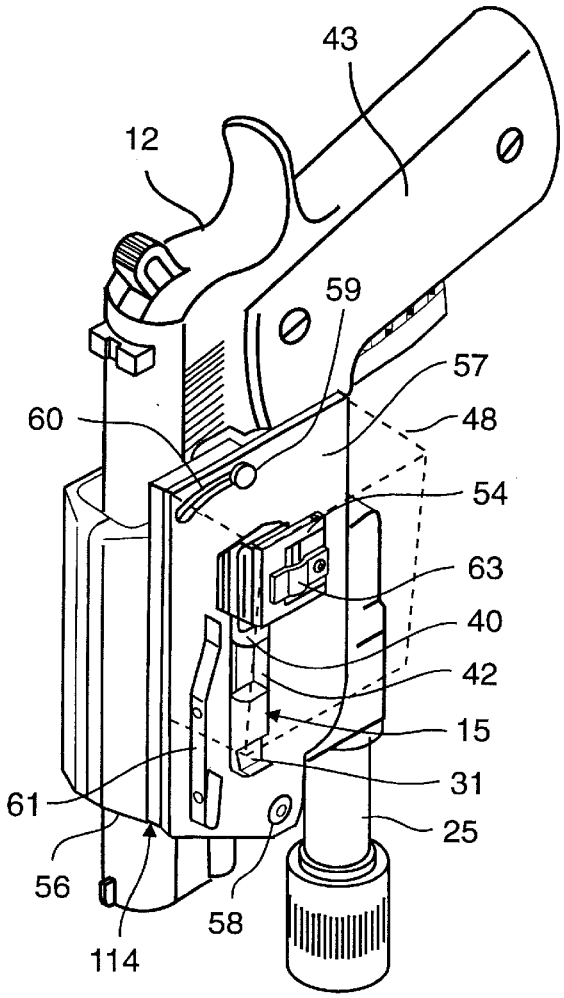
FIG. 8 is a perspective view of a holstering system according to yet another embodiment of the invention.
Figure 9:
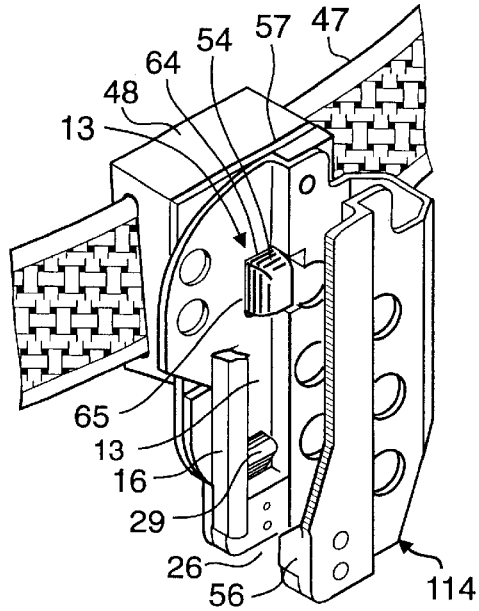
FIG. 9 is a detail view of the holstering system of FIG. 8; and in a different stage of operation.

By way of further example, such as shown in FIGS. 8 and 9, detent 54 may releasably retain or may be adapted to releasably retain the slide structure or adapter 15 at the track structure 13 until a wearer of the holstered hand weapon 12 angularly moves that hand weapon and the track structure 13.

Figure 10:
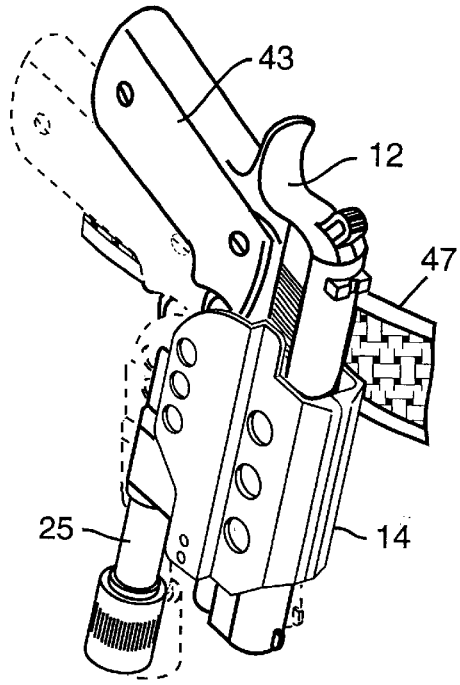
FIG. 10 is a perspective view similar to FIG. 8, but turned around showing in dotted outline a rest position of the holstering system and holstered weapon, and showing in solid outline a tilted position of weapon and holster, ready for a draw of the weapon.

According to an embodiment of the invention, the detent 54 is deactivated such as shown in FIGS. 8 to 10 by angular movement of the elongate hand weapon 12 and track structure 13.

For instance, according to the embodiment illustrated in FIGS. 8 to 10, a holstering device 114 includes an angularly moveable portion 56 and a relatively stationary portion 57. By way of example, the holster portion 56 may be pivoted at 58 on the portion 57. A slot and pin arrangement, including a pin 59 and an arcuate slot 60, may be used to limit angular movement or tilt of the hand weapon 12 and holster portion 56, from and between a rest position, such as shown in FIG. 8, in which the holster portion 56 may be held by a spring 61, to a position, such as seen in FIG. 10 in solid outline, which is fully tilted against the bias of the spring 61.

The track structure 13 is on the angularly moveable portion 57. A detent 54 is on the relatively stationary portion 57, and is positioned to engage the slide structure or adapter 15 when the hand weapon 12 is in that holstering device 114 prior to angular movement of the angularly moveable portion 56 with the hand weapon 12 relative to the stationary portion 57. The detent or latch 54 may engage the slide portion 15 of the hand weapon 12 at its notch 42, or at its upper end 115 (see FIG. 4) or in any other manner that will retain or block the weapon 12 in its holster 114 against forcible removal.

Within the scope of the invention, the slide structure or adapter 15 could simply be removed from the detent 54 as the hand weapon 12 and the track structure 13 and angularly moveable holster portion 56 which it engages are angularly moved preparatory to a draw of the hand weapon 12 from its holster 114.

However, for greater safety, the illustrated embodiment provides a detent deactivator 62 on the angularly moveable portion 56 of the holstering device 114. The detent 54 is located in a path of angular movement of such detent deactivator 59 which is on the angularly moveable portion 56. By way of example, the detent 54 may be resiliently mounted, such as by a leaf spring 63 attached to the stationary portion 57. Such resiliently mounted detent 54 may, for instance, project through an aperture 64 in the angularly moveable portion 56 to engage the slide structure or adapter 15 when the weapon 12 and its track structure 13 and angularly moveable holster portion 56 are in their rest position seen in FIG. 8 relative to FIG. 9.

The above mentioned detent deactivator 59 may, for instance, be an edge region 65 of the angularly moveable portion 56 at its aperture 64.

When the wearer of the holstered weapon 12 angularly moves the same, such as with his or her gun hand, so that the moveable holster portion 56 is angularly moved about its pivot 58, the detent deactivator edge 65 of the aperture 64 slides past the detent 54, thereby moving such detent out of the path of the angularly moving weapon 12 and slide portion 15, such as against the bias of the spring 63.

The weapon 12 may thus easily be pulled out of the holstering device with the gun hand. On the other hand, it would be difficult for an assailant to pull the weapon from the modified holster, especially since the wearer of the holstered weapon would not just stand by idly, while an assailant is working on his or her gun.

The adapter or slide structure 15, 115, 215 of or on the hand weapon may be universal for different types of holstering devices, such as for the holstering devices 14, 114 and 214 shown in FIGS. 1, 2, 2A to C, 3, 5 to 10 and 11 to 17.

An overall method according to this aspect of the invention may provide the track structure 13 and slide structure or adapter 15 with a detent 33 for releasably retaining that slide structure or adapter at that track structure against removal of the holstered hand weapon 12 from the holstering device 14. Such detent may be provided with a device 34 for sensing a presence of a part of a hand 51 of a wearer of the holstered hand weapon at a predetermined location 36 at the holstering device 14. The detent 33 may be or may remain deactivated in response to that presence of that part of said hand 51, such as of an outstretched index finger, at predetermined location 36, such as described above in conjunction with FIGS. 5 to 7.

This overall method according to the currently disclosed aspect of the invention also provides the holstering device 114 of FIGS. 8 to 10 as an alternative holstering device, and provides such alternative holstering device 114 with an alternative track structure which is complementary with the slide structure or adapter 15, and which may be similar or identical to the track structure 13, variations of which have been disclosed above. This method also provides the alternative holstering device 114 with an alternative detent 54 releasably retaining the slide structure or adapter 15 at the alternative track structure until a wearer of the holstered hand weapon angularly moves the hand weapon 12 and the alternative track structure 13, such as described above in conjunction with FIGS. 8 to 10 with respect to the angularly moveable holster portion 56.

An overall system as embodied in FIGS. 1, 2, 2A to C, 3, and 5 to 10 may include a detent 33 adapted to releasably retain a universal slide structure or adapter 15 at track structure 13 against removal of the holstered hand weapon 12 from holstering device 14. Such detent may include a device 34 adapted to sense a presence of a part of a hand 57 of a wearer of the holstered hand weapon at a predetermined location 36 at holstering device 44, and a device 37 with or without 40, adapted to deactivate detent 33 in response to presence of part of hand 51 at predetermined location 36. An alternative holstering device 114 for hand weapons with like slide structure or adapter 15 has an alternative track structure 13 in that alternative holstering device 114 complementary with such slide structure or adapter 15 and an alternative detent 54 adapted to releasably retain such slide structure or adapter 15 at its alternative track structure until a wearer of the holstered hand weapon angularly moves such hand weapon and the track structure 13 which at this point is designated as alternative, even though the track structure 13 of the embodiments shown in FIGS. 1, 2, 2A to C, 3, and 5 to 10 may be identical within the scope of the invention.

Hand weapon users thus are able to chose between different holstering systems.

Different people have different preferences, and the same people have different preferences for different tasks. For instance, where levers of the type shown at 37 in FIGS. 5 to 7 are disfavored, people likely would opt for the embodiment of FIGS. 8 to 10 that affords safety against violent hand weapon removal while requiring less of a conscious effort of the wearer to remove the weapon from its holster than do prior-art safety systems.

True professionals, however, likely will opt for the system exemplified in FIGS. 5 to 7, since that permits drawing of the hand weapon 12 without conscious effort as far as the detent 33 against violent removal is concerned. Especially where the detent 33 is uncocked by the upper slide portion 40 and remains uncocked during the entire draw by nothing more than the wearer's gun hand 51, the wearer does not have to do anything that he or she does not do already during the draw; namely, stretch down his or her trigger finger 52 ready for insertion into the trigger area 45 as soon as the weapon 12 is out of the holster.

The same person, police department or agency may, however, own or possess two or more of the embodiments herein disclosed, for different tasks or situations.

By way of example, the holstering device 14, 114 or 214 may be worn on a belt 47 and, for that purpose, may be provided with or may include a belt loop structure 48 that may be attached to or integral with the holster proper. However, the part 47 also may be symbolic of waist band and shoulder straps, and the like, within the scope of the invention.

The holstering device 214 according to the embodiment of the invention shown in FIGS. 11 to 16 also extends along opposite first and second sides of the holstered hand weapon 12 and also straddles that hand weapon between such opposite first and second sides when that hand weapon is holstered.

A track structure similar to the above mentioned track structure 13 is also provided in such holstering device 214, including a first track 16 at the first side and a second track 17 at the second side of the holstered hand weapon.

An adapter 215 for the hand weapon 12 has first and second lateral slides or tongues 18 and 19 complementary with the first and second tracks 16 and 17, respectively, of the track structure 13. As in the case of the adapter 15, the adapter 215 of FIGS. 11 to 21 is integral with the elongate hand weapon 12 as distinguished from the holstering device 214, so that such adapter 215 is removed with such elongate hand weapon 12 from the holstering device when that hand weapon is drawn from that holstering device 214.

Each complementary first track 16 and first slide 18 and each complementary second track 17 and second slide 19 comprises a tongue and groove combination including a tongue structure as one of such first track, first slide, second track and second slide, respectively, and a groove structure as the other of the first track, first slide, second track and second slide, respectively, in the manner already described above and illustrated in FIGS. 2 to 2C which also show slides 21 and 22 that could be used in FIGS. 11 to 16, such as at 18 and 19.

Figure 3:
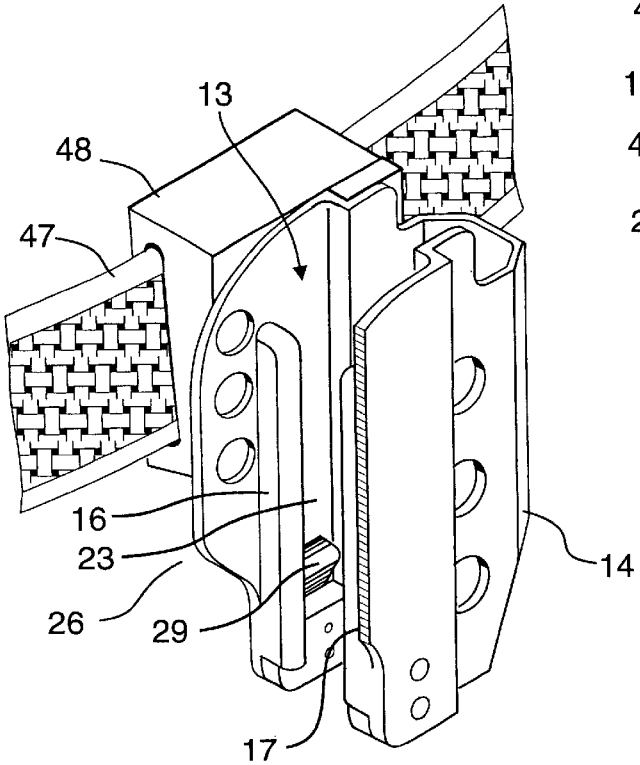
FIG. 3 is a perspective view similar to FIG. 1 but showing the holstering structure without the hand weapon, with an edge broken away for better visibility of the track structure.

The embodiment of the invention shown in FIGS. 11 to 16 also has a detent adapted to releasably retain the adapter at the track structure. Various detents have been disclosed above for that purpose. In this respect, FIGS. 1A and 14 to 19 show a detent 28 or 128 having a notch 31 or 131 in the adapter 15 or 215 and a latch 29 or 129 releasably retaining the adapter at that notch in the holstering device. Such latch preferably is at the track structure, such as seen in FIGS. 3 and as more fully described below with respect to FIGS. 11 to 19.

In the latter illustrated embodiment of the invention, the adapter 215 has a first notch 131 at the first track 16 and a second notch 132 at the second track 17 when the hand weapon is holstered. Similarly, the holstering device 214 has a first latch 129 at the first track structure 16 engaging the first notch 131, and a second latch 130 at the second track structure 17 engaging the second notch 132 when the hand weapon is holstered.

According to FIGS. 1A, 4, 15, 20 and 21, for instance, the adapter 15 or 215 has a concave notch 31 or 131, and the holstering device 14 or 214 has a spring-biased latch 29 or 129 such as seen in FIGS. 14 to 16, 18 and 19. In this respect, the embodiment of FIGS. 11 to 16, 18 and 19 has that latch as a roller at 129 at the track structure 13 or track 16 engaging the adapter 215 at its concave notch 131 when the hand weapon is holstered.

Figure 16:
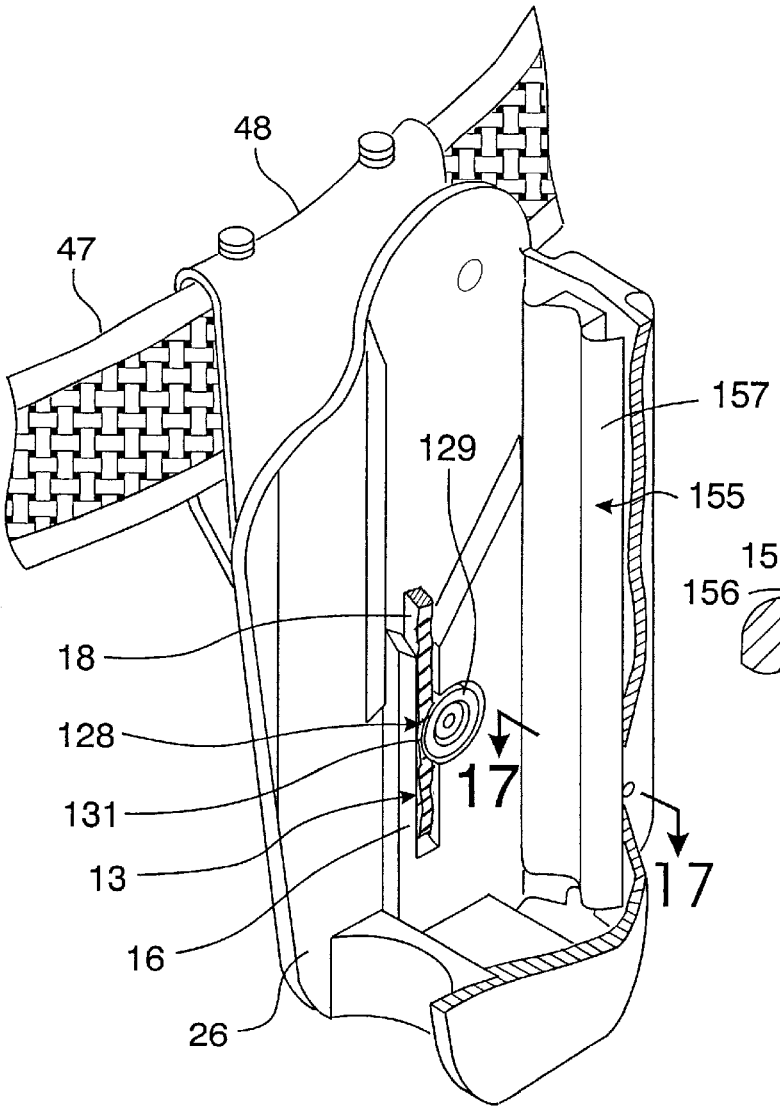
FIG. 16 is a perspective view similar to FIG. 14, but having the edge portion further broken away for better visibility of a detent structure and of an elongate weapon accommodator.

In the embodiment of the invention seen for instance in FIGS. 15 and 16, the adapter 215 has a first concave notch 131 at the first track 16 and a second concave notch 132 at the second track 17 when the hand weapon is holstered. Similarly, the holstering device 214 has a first spring-biased latch including a first roller at 129 at the first track structure engaging the first concave notch 131, and a second spring-biased latch including a second roller at 130 at the second track structure engaging the second concave notch 132 when the hand weapon is holstered.

According to FIGS. 1A and 3, the latch 29 in detent 28 is spring-biased. In the embodiment of FIGS. 11 to 19, the latch of detent 128 has a spring-biased lever 134 pivoted in the holstering device 214, a roller at 129 journaled on that lever. That detent also includes a concave notch 131 in the adapter 215 releasably engaged by that roller when the hand weapon is holstered in the holstering device.

Pursuant to the embodiment illustrated in FIGS. 11 to 19, the detent has a first spring-biased lever 134 pivoted in the holstering device 214, a first roller at 129 journaled on that first lever, and a first concave notch 131 in the adapter releasably engaged by that first roller when the hand weapon is holstered in the holstering device, a second spring-biased lever 136 pivoted in the holstering device, a second roller at 130 journaled on that second lever, and a second concave notch 132 in the adapter releasably engaged by that second roller when the hand weapon is holstered in the holstering device.

Various means may be employed for spring-biasing the detents 28 or 128. FIGS. 1A and 3 show leaf springs. The embodiment of FIGS. 11 to 19 by way of example has helical springs 137 and 138 for biasing the levers 134 and 136 into engagement with the adapter 215 and its notches 131 and 132.

Figure 19:
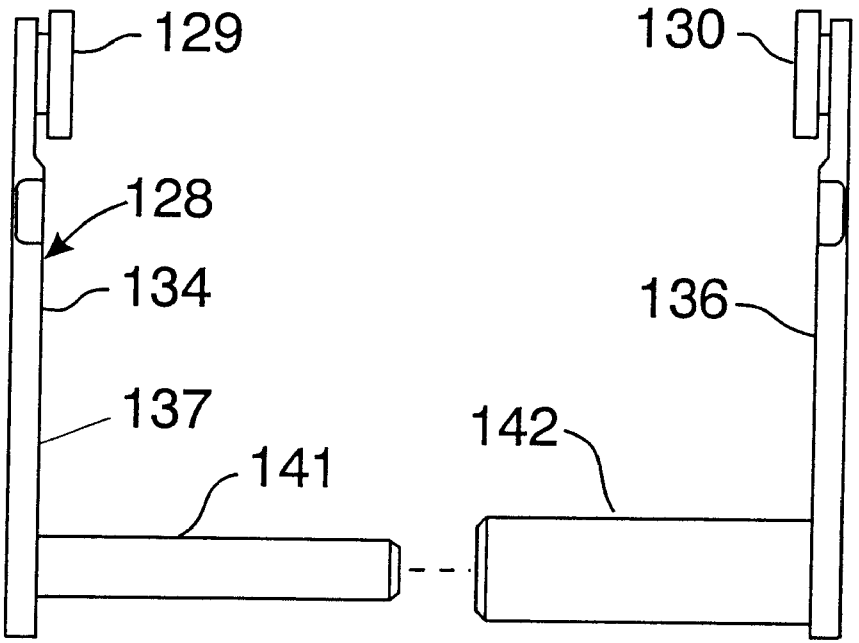
FIG. 19 is an elevation of a dual roller-type detent used in the holstering structure as seen in FIGS. 14 to 16 according to an embodiment of the invention.
Figure 18:
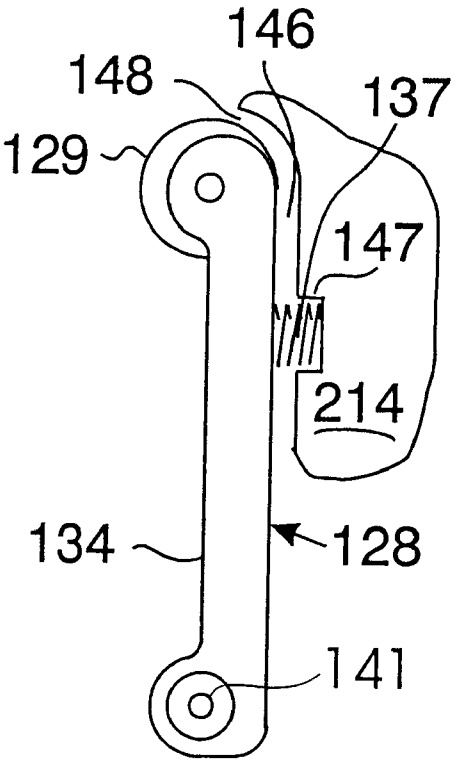
FIG. 18 is a side view of a roller-type detent used in the holstering structure as seen in FIGS. 14 to 16 according to an embodiment of the invention.

According to the embodiment shown in the exploded view of FIG. 19, the first and second levers 134 and 136 have complementary journals 141 and 142, such as in the form of telescoping journals 141 and 142 when they are pushed together in the assembly in the holstering device 214.

Figure 14:
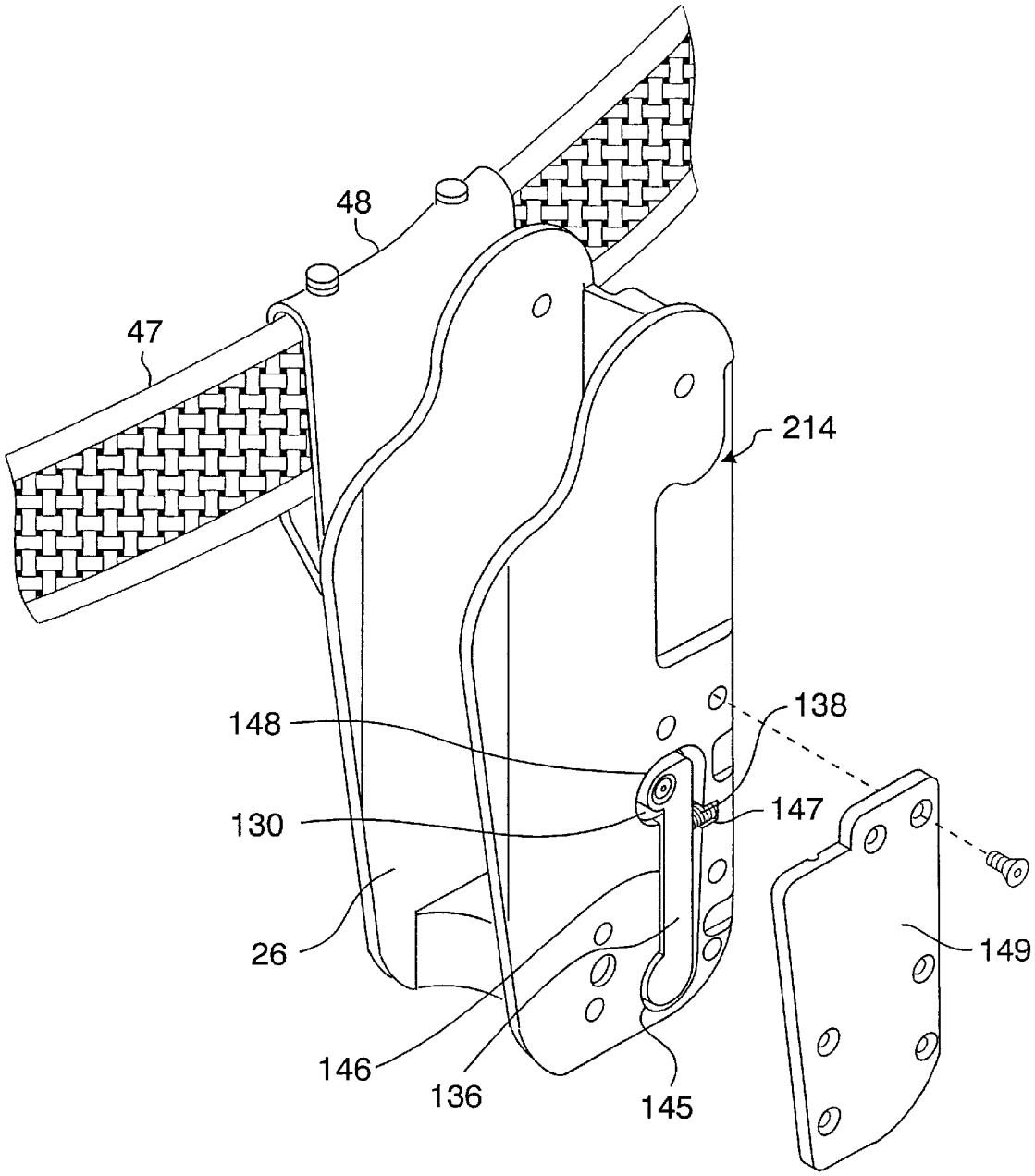
FIG. 14 is a perspective view similar to FIG. 12, but without the locking mechanism seen in FIGS. 12 and 13, and with a cover plate removed to show a detent containment system according to an embodiment of the invention.

In this respect and in general, FIGS. 14 and 15 show an aperture 145 in one side of the holstering device 214 for accommodating the lever journal at 142, a slot 146 for accommodating the detent lever 136, a transverse slot 147 for accommodating the detent bias spring 138. FIG. 15 also shows an aperture 148 for accommodating the roller at 130 at the track structure or track 17. Similar apertures and slots may be provided in the other side of the holstering device for accommodation of the lever 136 with its journal, its spring-bias and its detent roller 130. A cover 149 may be provided over the side of the holstering device 214 at the detent roller and lever mechanism 130, 136 and 138 or over slots 145, 146 and 148.

As in the case of other embodiments herein shown, the adapter 215 has an accommodation for part of the trigger guard 45 and may be attached to part of the hand weapon 12 by fasteners 108, 109, 110 and 111. Clamping may be further enhanced by provision of clamping pads 116 and 117 of a shock-absorbing material, such as rubber, an elastomer or Neoprene®.

As in the case of the other holstering devices shown in FIGS. 1 to 10, the holstering device 214 preferably is open along one side thereof and also may include an accommodation for an accessory 25, and the adapter 215 may have a mount 113 for such accessory.

The holstering device 214 according to the embodiment shown in FIGS. 11 to 16 also may serve as a standard holstering device for a number of different types of elongate hand weapons, such as disclosed above.

Figure 17:
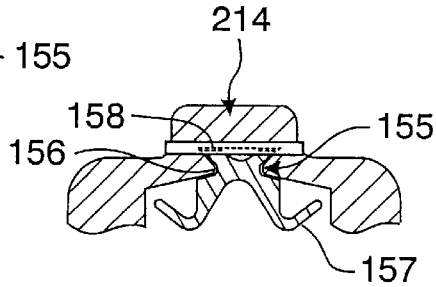
FIG. 17 is a section taken on line 17—17 in FIG. 16 in the vicinity of the elongate weapon accommodator.

An embodiment of the invention shown with the aid of FIGS. 16 and 17 also has an elongate removable hand weapon accommodation or accommodator and guide 155 that in effect guides the weapon as it is being holstered and that preferably aids in retaining the weapon in the holster, such as by preventing rattling or other looseness of the holstered weapon.

By way of example, the holstering device 214 has an elongate groove 156, such as seen in FIG. 17 and the weapon accommodator 155 has a rail 157 having a footing 158 inserted in that elongate groove. As seen in FIGS. 16 and 17, the rail 157 may have any suitable configuration for optimum accommodation of certain type of weapons in the holstering device. In other words, the configuration of the rail 157 may be adapted to particular kinds of weapons, such as to at least one of the types of hand weapons accommodated in the universal holstering device 214, thereby supplementing the adapter 15, 115 or 215.

The weapon accommodator 155 may be removed from the holstering device, such as by removal of the rail 157 with its footing 158 from the groove 156, thereby adapting the holstering device to another type of hand weapon that requires more clearance inside the holster than what the clearance variator 155 has been designed for. Different accommodators of the kind shown in FIGS. 16 and 17 may be designed for different kind of weapons.

This combination of features makes the holstering devices pursuant to embodiments of the invention truly universal holsters for a variety of hand weapons.

According to an embodiment of the invention, the hand weapon is releasably retained in the holstering device by releasable engagement of that hand weapon while holstered in that holstering device.

Figure 11:
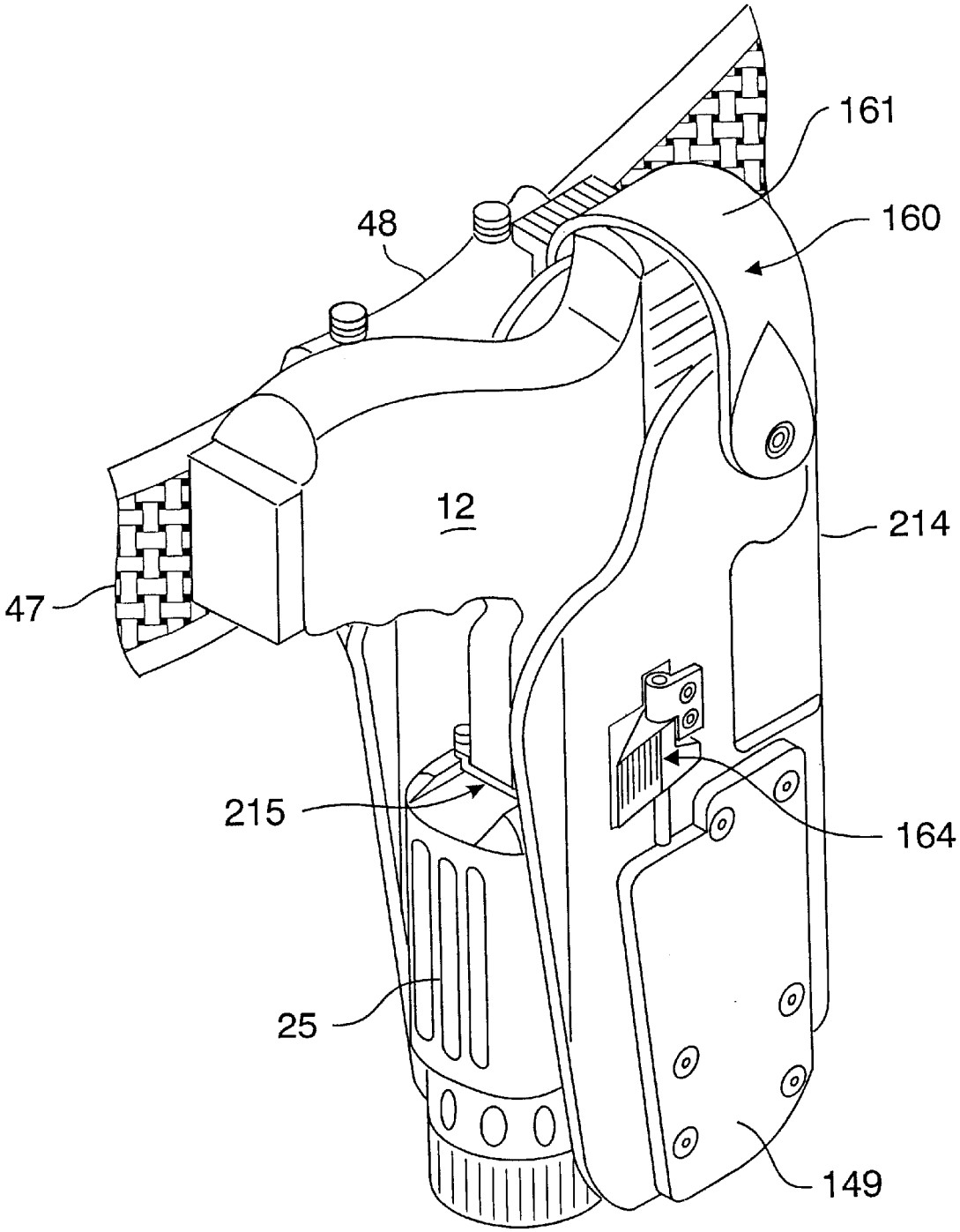
FIG. 11 is a perspective view of a hand weapon holstering system according to a further embodiment of the invention.
Figures 12, 13:
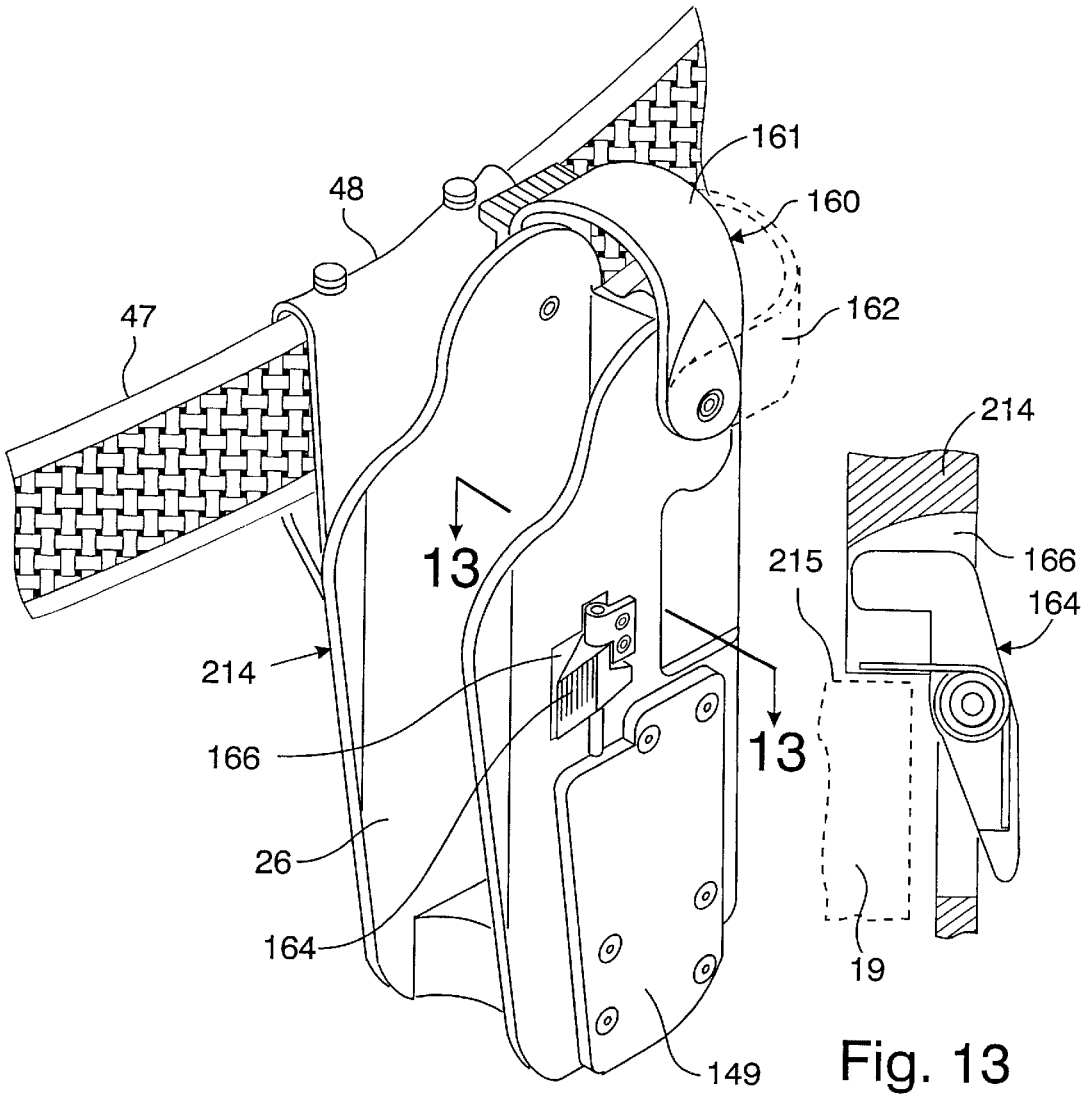
FIG. 12 is a perspective view similar to FIG. 11, but showing the holstering structure without the hand weapon.
FIG. 13 is a detail of a section taken on line 13—13 in FIG. 12 and showing a locking mechanism.

By way of example, FIGS. 11 and 12 in this respect show a manually actuable weapon retainer strap 160 pivoted on the holstering device 214 having a weapon retaining position 161 over a hand weapon 12 holstered in that holstering device, and having an alternative weapon release position 162 away from that hand weapon holstered in that holstering device. In other words, the manually actuable weapon retainer strap 160 has its first position 161 in the path of the weapon 12 when ready to be drawn from the holstering device. Accordingly, an assailant cannot simply grab the weapon 12 from the holstering device worn by a police officer, for instance. Also, when such police officer or other wearer of the holstering device has to jump, roll over or go through other motions, the retainer strap 160 when in its first position 161 will safely prevent the weapon 12 from falling out of the holstering device.

On the other hand, when the wearer of the holstering device is ready to draw the weapon 12, then he or she will manually actuate the retainer strap 160 to its second position out of the way of the weapon 12 which may then be drawn as desired and necessary.

Alternatively or, if desired additionally, the hand weapon may be releasably retained in its holstering device by releasable engagement of the adapter 15, 115, 215 while the hand weapon is holstered in that holstering device.

By way of example, FIGS. 11 to 13 show a manually actuable weapon blocker 164 having a weapon blocking position in a path of the adapter 215 of the hand weapon 12 holstered in the holstering device 214, and having a weapon release position away from the path of that adapter.

In this respect, FIGS. 11 to 13 show the weapon blocker 164 as a latch pivoted on the holstering device 214 at an aperture 166 thereof. As seen in FIG. 13, part of that latch reaches over part of the adapter 215 or its lateral slide or tongue 19 (see FIGS. 15 and 20 for a fuller view of such adapter) when the hand weapon 12 is holstered in the holstering device 214. The latch 164 thus blocks removal of the weapon to which such adapter is attached from its holstering device.

Accordingly, an assailant cannot simply grab the weapon 12 from the holstering device worn by a police officer, for instance. Also, when such police officer or other wearer of the holstering device has to jump, roll over or go through other motions, the weapon blocker 164 is in its active position solidly illustrated in FIGS. 11 to 13 will safely prevent the weapon 12 from falling out of the holstering device.

On the other hand, when the wearer of the holstering device is ready to draw the weapon 12, then he or she will manually actuate the weapon blocker 164 to an inactive position out of the way of the weapon adapter 215, so that the weapon 12 may then be drawn as desired and necessary.

By way of example, a wearer of the holstering device ready to draw the weapon may depress the pivoted weapon blocker or latch 164 with his or her then outstretched trigger finger, whereby such weapon blocker is moved out of the path of adapter 215. Reference may in this respect be had to FIG. 7 that shows a similar actuation of a blocking mechanism or lever 37 by the outstretched index or trigger finger 52 of the marksman or person.

Such marksman or person may thus draw the weapon and bend his or her outstretched trigger finger inwardly onto the trigger 46 of the weapon, ready to fire at a murderous assailant, for instance.

The extensive disclosure provided herein and in the accompanying drawings, claims and abstract will render apparent or suggest to those skilled in the art various modifications and variations within the spirit and scope of the invention.

I claim:

1. In a method of holstering an elongate hand weapon, the improvement comprising in combination:

forming a holstering device for said hand weapon extending along opposite first and second sides of said hand weapon and straddling said hand weapon between said opposite first and second sides when said hand weapon is holstered;

providing a track structure including in said holstering device a first track at said first side and a second track at said second side;

equipping said elongate hand weapon with an adapter having first and second slides complementary with said first and second tracks of said track structure for holstering said adapter in said track structure while holstering said elongate hand weapon in said holstering device; and making said adapter integral with said elongate hand weapon as distinguished from said holstering device, so that said adapter is removed with said elongate hand weapon from said holstering device when said hand weapon is drawn from said holstering device.

2. A method as in claim 1, wherein:

said track structure and said adapter are shaped as a tongue and groove combination including a tongue structure as one of said track structure and said adapter, and a groove structure as the other of said track structure and said adapter.

3. A method as in claim 1, wherein:

said holstering device and said adapter are equipped with a detent releasably retaining said adapter at said track structure.

4. A method as in claim 1, wherein:

said hand weapon is releasably retained in said holstering device by releasable engagement of said hand weapon while holstered in said holstering device.

5. A method as in claim 1, wherein:

said hand weapon is releasably retained in said holstering device by releasable engagement of said adapter while said hand weapon is holstered in said holstering device.

6. In a method of holstering any one of a number of different types of elongate hand weapons, the improvement comprising in combination:

making for said different types of hand weapons a standard holstering device extending along opposite first and second sides of any of said hand weapons and straddling that hand weapon between said opposite first and second sides when that hand weapon is holstered;

providing a track structure including in said holstering device a first track at said first side and a second track at said second side;

equipping each of said elongate hand weapons with an adapter having first and second slides complementary with said first and second tracks of said track structure for holstering said adapter in said track structure while holstering any of said elongate hand weapon in said holstering device; and making each adapter integral with a corresponding elongate hand weapon as distinguished from said holstering device, so that said adapter is removed with that elongate hand weapon from said holstering device when that hand weapon is drawn from said holstering device.

7. A method as in claim 6, wherein:

said track structure and said adapter are shaped as a tongue and groove combination including a tongue structure as one of said track structure and said adapter, and a groove structure as the other of said track structure and said adapter.

8. A method as in claim 6, wherein:

said holstering device and said adapter are equipped with a detent releasably retaining said adapter at said track structure.

9. In apparatus for holstering an elongate hand weapon, the improvement comprising in combination:

a holstering device for said hand weapon extending along opposite first and second sides of said hand weapon and straddling said hand weapon between said opposite first and second sides when said hand weapon is holstered;

a track structure including in said holstering device a first track at said first side and a second track at said second side; and an adapter for said hand weapon having first and second slides complementary with said first and second tracks of said track structure and being integral with said elongate hand weapon as distinguished from said holstering device, so that said adapter is removed with said elongate hand weapon from said holstering device when said hand weapon is drawn from said holstering device.

10. Apparatus as in claim 9, wherein:

each complementary first track and first slide and each complementary second track and second slide comprises a tongue and groove combination including a tongue structure as one of said first track, first slide, second track and second slide, respectively and a groove structure as the other of said first track, first slide, second track and second slide, respectively.

11. Apparatus as in claim 9, including:

a detent adapted to releasably retain said adapter at said track structure.

12. Apparatus as in claim 9, including:

a manually actuable weapon retainer strap on said holstering device having a weapon retaining position over a hand weapon holstered in said holstering device, and having a weapon release position away from said hand weapon holstered in said holstering device.

13. Apparatus as in claim 9, including:

a manually actuable weapon blocker having a weapon blocking position in a path of said adapter of a hand weapon holstered in said holstering device, and having a weapon release position away from said path of said adapter.

14. Apparatus as in claim 9, wherein:

said holstering device is substantially open along one side thereof.

15. Apparatus as in claim 9, wherein:

said adapter has a notch; and said holstering device has a latch releasably retaining said adapter at said notch.

16. Apparatus as in claim 9, wherein:

said adapter has a notch; and said holstering device has a latch at said track structure releasably retaining said adapter at said notch.

17. Apparatus as in claim 9, wherein:

said adapter has a first notch at said first track and a second notch at said second track when said hand weapon is holstered; and said holstering device has a first latch at said first track structure engaging said first notch, and a second latch at said second track structure engaging said second notch when said hand weapon is holstered.

18. Apparatus as in claim 9, wherein:

said adapter has a concave notch; and said holstering device has a spring-biased latch including a roller at said track structure engaging said adapter at said concave notch when said hand weapon is holstered.

19. Apparatus as in claim 9, wherein:

said adapter has a first concave notch at said first track and a second concave notch at said second track when said hand weapon is holstered; and said holstering device has a first spring-biased latch including a first roller at said first track structure engaging said first concave notch, and a second spring-biased latch including a second roller at said second track structure engaging said second concave notch when said hand weapon is holstered.

20. Apparatus as in claim 9, including:

a detent having a spring-biased lever pivoted in said holstering device, a roller journaled on said lever, and a concave notch in said adapter releasably engaged by said roller when said hand weapon is holstered in said holstering device.

21. Apparatus as in claim 9, including:

a detent having a first spring-biased lever pivoted in said holstering device, a first roller journaled on said first lever, and a first concave notch in said adapter releasably engaged by said first roller when said hand weapon is holstered in said holstering device, a second spring-biased lever pivoted in said holstering device, a second roller journaled on said second lever, and a second concave notch in said adapter releasably engaged by said second roller when said hand weapon is holstered in said holstering device.

22. Apparatus as in claim 21, wherein:

said first and second levers have complementary journals in said holstering device.

23. Apparatus as in claim 9, for elongate hand weapons having a trigger with trigger guard, wherein:

said adapter has an accommodation for part of said trigger guard.

24. Apparatus as in claim 9, for a hand weapon having an exterior accessory, wherein:

said holstering device includes an accommodation for said accessory.

25. Apparatus as in claim 9, for a hand weapon having an exterior accessory, wherein:

said adapter has a mount for said accessory.

26. In apparatus for holstering any one of a number of different types of elongate hand weapons, the improvement comprising in combination:

a standard holstering device for said different types of hand weapons extending along opposite first and second sides of any of said hand weapons and straddling that hand weapon between said opposite first and second sides when that hand weapon is holstered;

a track structure including in said holstering device a first track at said first side and a second track at said second side; and an adapter for each of said hand weapons having first and second slides complementary with said first and second tracks of said track structure and being integral with that elongate hand weapon as distinguished from said holstering device, so that said adapter is removed with that elongate hand weapon from said holstering device when that hand weapon is drawn from said holstering device.

27. Apparatus as in claim 26, wherein:

each complementary first track and first slide and each complementary second track and second slide comprises a tongue and groove combination including a tongue structure as one of said first track, first slide, second track and second slide, respectively and a groove structure as the other of said first track, first slide, second track and second slide, respectively.

28. Apparatus as in claim 26, including:

a detent adapted to releasably retain said adapter at said track structure.

29. Apparatus as in claim 26, including:

a manually actuable weapon retainer strap on said holstering device having a weapon retaining position over a hand weapon holstered in said holstering device, and having a weapon release position away from said hand weapon holstered in said holstering device.

30. Apparatus as in claim 26, including:

a manually actuable weapon blocker having a weapon blocking position in a path of said adapter of a hand weapon holstered in said holstering device, and having a weapon release position away from said path of said adapter.

31. Apparatus as in claim 26, wherein:

said holstering device is substantially open along one side thereof.

32. Apparatus as in claim 26, wherein:

said adapter has a notch; and said holstering device has a latch releasably retaining said adapter at said notch.

33. Apparatus as in claim 26, wherein:

said adapter has a notch; and said holstering device has a latch at said track structure releasably retaining said adapter at said notch.

34. Apparatus as in claim 26, wherein:

said adapter has a first notch at said first track and a second notch at said second track when said hand weapon is holstered; and said holstering device has a first latch at said first track structure engaging said first notch, and a second latch at said second track structure engaging said second notch when said hand weapon is holstered.

35. Apparatus as in claim 26, wherein:

said adapter has a concave notch; and said holstering device has a spring-biased latch including a roller at said track structure engaging said adapter at said concave notch when said hand weapon is holstered.

36. Apparatus as in claim 26, wherein:

said adapter has a first concave notch at said first track and a second concave notch at said second track when said hand weapon is holstered; and said holstering device has a first spring-biased latch including a first roller at said first track structure engaging said first concave notch, and a second spring-biased latch including a second roller at said second track structure engaging said second concave notch when said hand weapon is holstered.

37. Apparatus as in claim 26, including:

a detent having a spring-biased lever pivoted in said holstering device, a roller journaled on said lever, and a concave notch in said adapter releasably engaged by said roller when said hand weapon is holstered in said holstering device.

38. Apparatus as in claim 26, including:

a detent having a first spring-biased lever pivoted in said holstering device, a first roller journaled on said first lever, and a first concave notch in said adapter releasably engaged by said first roller when said hand weapon is holstered in said holstering device, a second spring-biased lever pivoted in said holstering device, a second roller journaled on said second lever, and a second concave notch in said adapter releasably engaged by said second roller when said hand weapon is holstered in said holstering device.

39. Apparatus as in claim 38, wherein:

said first and second levers have complementary journals in said holstering device.

40. Apparatus as in claim 26, for elongate hand weapons having a trigger with trigger guard, wherein:

said adapter has an accommodation for part of said trigger guard.

41. Apparatus as in claim 26, for a hand weapon having an exterior accessory, wherein:

said holstering device includes an accommodation for said accessory.

42. Apparatus as in claim 26, for a hand weapon having an exterior accessory, wherein:

said adapter has a mount for said accessory.

43. Apparatus as in claim 26, including:

an elongate removable hand weapon accommodator and guide in said holstering device.

44. Apparatus as in claim 43, including:

an elongate groove in said holstering device receiving part of said elongate removable hand weapon accommodator and guide.

45. Apparatus as in claim 43, wherein:

said elongate removable hand weapon accommodator and guide has a configuration adapted to at least one of said different types of elongate hand weapons.

* * * * *

UNITED STATES PATENT AND TRADEMARK OFFICE

CERTIFICATE OF CORRECTION

PATENT NO. : 6,267,279 B1
DATED : July 31, 2001
INVENTOR(S) : John Wallace Matthews It is certified that error appears in the above-identified patent and that said Letters Patent is hereby corrected as shown below:

Title page,
Related U.S. Application Data, section after "Pat. No. 6,112,962", the following data should be inserted:
-- , as National Phase of International Application PCT/US 95/09471 filed on July 26, 1995 --

Column 7,
Line 48, "gun hands" should be -- gun hand --.

Signed and Sealed this

Twenty-sixth Day of February, 2002

*Attest:*

*Attesting Officer*

JAMES E. ROGAN
*Director of the United States Patent and Trademark Office*